US007464832B2

(12) United States Patent
Lee

(10) Patent No.: US 7,464,832 B2
(45) Date of Patent: Dec. 16, 2008

(54) MEDIA CASSETTE WITH INTERNAL LOCK

(75) Inventor: Byung-Mok Lee, Suwon (KR)

(73) Assignee: LG N-SYS Inc., Seoul (KR)

( * ) Notice: Subject to any disclaimer, the term of this patent is extended or adjusted under 35 U.S.C. 154(b) by 228 days.

(21) Appl. No.: 10/992,671

(22) Filed: Nov. 22, 2004

(65) Prior Publication Data

US 2005/0140084 A1 Jun. 30, 2005

(30) Foreign Application Priority Data

Dec. 31, 2003 (KR) ..... 10-2003-0101535

(51) Int. Cl.
*G07F 7/00* (2006.01)
*G07F 19/00* (2006.01)

(52) U.S. Cl. ..... 221/12; 221/9; 221/191; 221/282; 235/379; 235/380; 235/381

(58) Field of Classification Search ..... 221/191–196; 235/379–382.5; 705/43–45; 902/8–15
See application file for complete search history.

(56) References Cited

U.S. PATENT DOCUMENTS 4,113,140 A * 9/1978 Graef et al. ..... 221/6
4,275,667 A 6/1981 Hilton
5,315,656 A * 5/1994 Devaux et al. ..... 705/50
5,615,625 A * 4/1997 Cassidy et al. ..... 109/45
5,709,315 A * 1/1998 Kahler et al. ..... 221/155
6,014,649 A * 1/2000 Kobayashi et al. ..... 705/43
6,065,408 A * 5/2000 Tillim et al. ..... 109/25
6,474,122 B2 * 11/2002 Davis ..... 70/278.3
6,592,118 B2 * 7/2003 Youn ..... 271/147
6,786,354 B2 * 9/2004 Black et al. ..... 221/6
6,824,046 B2 * 11/2004 Brexel et al. ..... 235/379
6,874,682 B2 * 4/2005 Utz et al. ..... 235/379
6,901,239 B2 * 5/2005 Ahn ..... 399/405
6,935,558 B2 * 8/2005 Washington et al. ..... 235/380
6,997,377 B2 * 2/2006 Washington et al. ..... 235/379
7,000,832 B2 * 2/2006 Washington et al. ..... 235/380
7,004,383 B2 * 2/2006 Graef et al. ..... 235/379
7,070,111 B2 * 7/2006 Washington et al. ..... 235/486

(Continued)

FOREIGN PATENT DOCUMENTS

EP 0 004 436 A3 10/1979

(Continued)

*Primary Examiner*—Gene Crawford
*Assistant Examiner*—Michael K Collins
(74) *Attorney, Agent, or Firm*—Birch, Stewart, Kolasch & Birch, LLP

(57) ABSTRACT

The media cassette for a media dispenser includes a cassette body including a storage space in which media are filled. A media discharging opening is provided at a side thereof. A discharging door is movable along one surface of the cassette body and driven by means of a driving source provided at a main body of the media dispenser for opening and closing the media discharging opening. Supporting rods are connected to the door. A locking mechanism for selectively blocking ends of the supporting rods is provide in the cassette body and selectively locks/unlocks the door in accordance with an electrical signal transmitted from the main body of the media dispenser. The door cannot be manually unlocked from outside of the media cassette.

18 Claims, 6 Drawing Sheets

U.S. PATENT DOCUMENTS

| | | | | |
|---|---|---|---|---|
| 7,165,717 | B2 * | 1/2007 | Matzig | 235/379 |
| 2001/0045452 | A1 * | 11/2001 | Momose et al. | 235/379 |
| 2002/0053767 | A1 * | 5/2002 | So | 271/10.01 |
| 2004/0164147 | A1 * | 8/2004 | Jenkins et al. | 235/382 |
| 2005/0140079 | A1 * | 6/2005 | Lee | 271/34 |
| 2005/0233472 | A1 * | 10/2005 | Kao et al. | 436/180 |

FOREIGN PATENT DOCUMENTS

| | | | |
|---|---|---|---|
| EP | 0 172 953 | B1 | 3/1986 |
| EP | 0 758 120 | B1 | 2/1997 |
| WO | WO-97/31342 | A1 | 8/1997 |

* cited by examiner

MEDIA CASSETTE WITH INTERNAL LOCK

The present application claims, under 35 U.S.C. § 119, the priority benefit of Korean Patent Application No. P03-101535 filed Dec. 31, 2003, the entire contents of which are herein fully incorporated by reference.

BACKGROUND OF THE INVENTION

1. Field of the Invention

The present invention relates to a media cassette for a media dispenser. More particularly, the present invention relates to an open/close device for a media cassette, detachably installed in the media dispenser, wherein a structure for locking a door is included in the media cassette.

2. Description of the Related Art

FIG. 1 shows a schematic configuration of a related art media dispenser 1. Referring to this figure, a media cassette 3 is installed at a lower rear end of a media dispenser 1. The media cassette 3 is filled with media that should be discharged. The media cassette 3 can be detached from the media dispenser 1 to fill media into the media cassette 3.

A media pickup part 5 is provided in the media dispenser. The media pickup part 5 separates the media filled in the media cassette 3 sheet by sheet. The media in the media cassette 3 are separated sheet by sheet and discharged to the outside.

As illustrated in bold lines in FIG. 1, the media separated in and discharged from the media cassette 3 by means of the media pickup part 5 are sorted and transferred to a discharging part 11 and a reject box 13 through a feed module 7 and a delivery module 9. The discharging part 11 supplies the media passed through the media cassette 3 to a user. The reject box 13 collects inferior media or the media supplied in a state where a plurality of media are fed together.

However, the aforementioned related art has several problems.

To fill the media cassette 3 with media, the media cassette 3 should be detached from the media dispenser 1 and then again mounted into the media dispenser 1. Thus, to prevent the media from being stolen while the media cassette 3 is removed, after being detached from the media dispenser, a door of the media cassette 3 should be generally locked using an additional lock.

However, there is a problem in that an operator obtains the media cassette 3 with its door inadvertently unlocked or a person other than the operator intentionally steals the media from the media cassette 3.

In particular, if a structure for locking the door of the media cassette 3 is installed at the outside of the media cassette 3, there is another problem in that the media may be stolen by picking the lock without having the media cassette 3 broken.

SUMMARY OF THE INVENTION

Accordingly, the present invention is conceived to solve one or more of the problems in the related art. An object of the present invention is to reduce the possibility of having media stolen during carrying a media cassette.

Another object of the present invention is to allow a structure for locking a door of a discharging opening of a media cassette where the locking structure is invisible from the outside of the media cassette by installing the locking structure within the media cassette.

A further object of the present invention is to allow a media cassette to be automatically fastened or attached to a media dispenser whenever a door of a discharging opening of the media cassette is opened and the media cassette is mounted in the media dispenser.

According to the present invention, there is provided an open/close device of a media cassette for a media dispenser, comprising a cassette body including a space in which media are filled and a media discharging opening, at a side thereof, through which the media are discharged. A discharging door is movable along one surface of the cassette body and driven by means of a driving source provided at a main body of the media dispenser for opening and closing the media discharging opening. A supporting rod is connected to the discharging door to extend in a direction in which the discharging door is opened and closed. A locking mechanism selectively supports an end of the supporting rod in the cassette body and selectively locks/unlocks the discharging door, in accordance with an electrical signal transmitted from the main body of the media dispenser.

Preferably, the direction in which the discharging door is opened and closed is perpendicular to a direction in which the supporting rod is moved, and the discharging door and the supporting rod are connected to each other by a connection chain.

Preferably, at least two supporting rods, with lengths different from each other, are installed in parallel with each other.

The locking mechanism may comprise a solenoid installed within the cassette body. A plunger can be moved into and out from the solenoid. A locking plate, which is connected to the plunger, is driven by the solenoid and includes stopper portions for selectively supporting the end of the supporting rod.

The plunger may be inserted into the solenoid when the solenoid is powered, and the plunger may protrude from the solenoid, by means of an elastic force of an elastic member, when the power is shut off.

Preferably, a rod guide channel along which the supporting rod is moved, and a stopper guide channel along which the stopper portions of the locking plate are moved, are formed in the cassette body by means of guide ribs to be perpendicular to each other.

Preferably, the device of the present invention further comprises a door closing mechanism for allowing the discharging door to clearly close the media discharging opening.

The door closing mechanism may comprise a closing rod connected to an end of the discharging door within the media cassette. An elastic member is connected to the closing rod at one end thereof and to the media cassette at the other end thereof. The elastic member imparts an elastic force in a direction in which the discharging door is closed.

According to the open/close device of the media cassette for the media dispenser of the present invention, since the structure for locking the door that opens and closes the media discharging opening of the media cassette is installed within the media cassette, it cannot be easily unlocked from the outside. Therefore, the possibility of having the media within the media cassette stolen can be reduced. If the discharging door is opened when the media cassette is mounted to the media dispenser, the media cassette is automatically fastened to the media dispenser. Therefore, there is an advantage in that the media cassette cannot be freely detached from the media dispenser with the discharging door open.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 1:
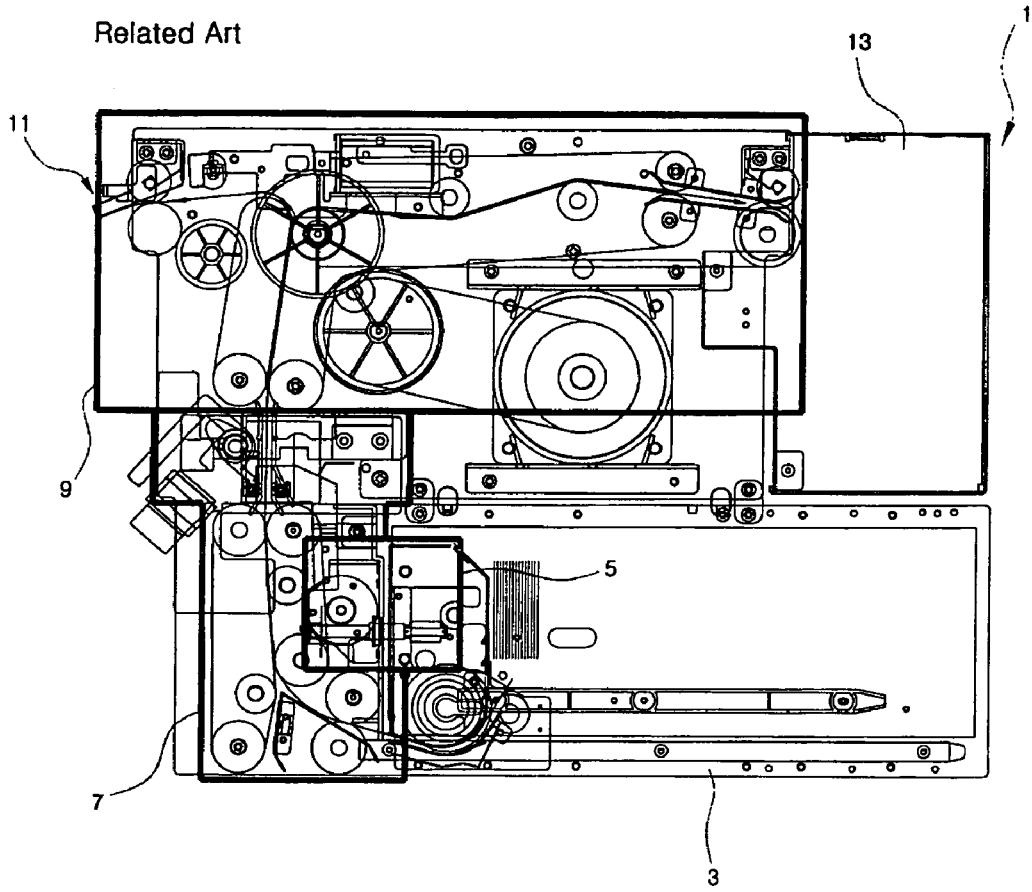
FIG. 1 is a sectional view showing the configuration of a related art media dispenser.
Figure 2:
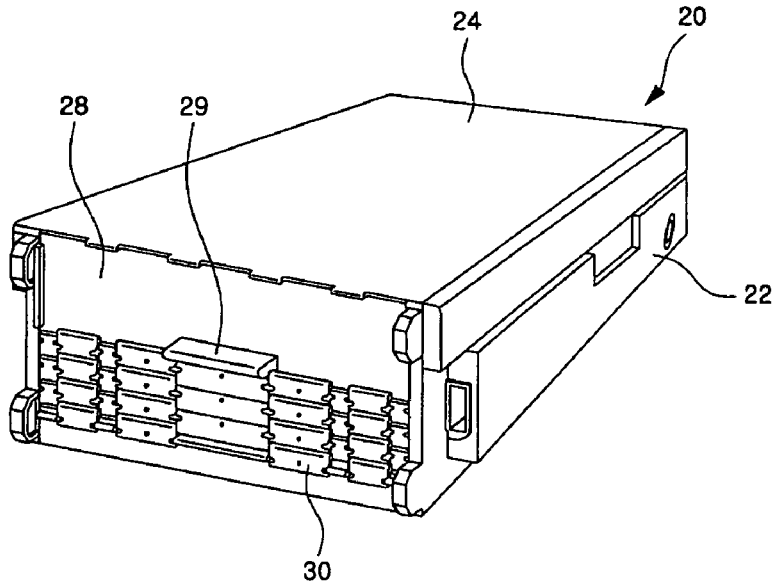
FIG. 2 is a perspective view showing the external appearance of a media cassette to which an embodiment of an open/close device according to the present invention is applied.
Figure 3:
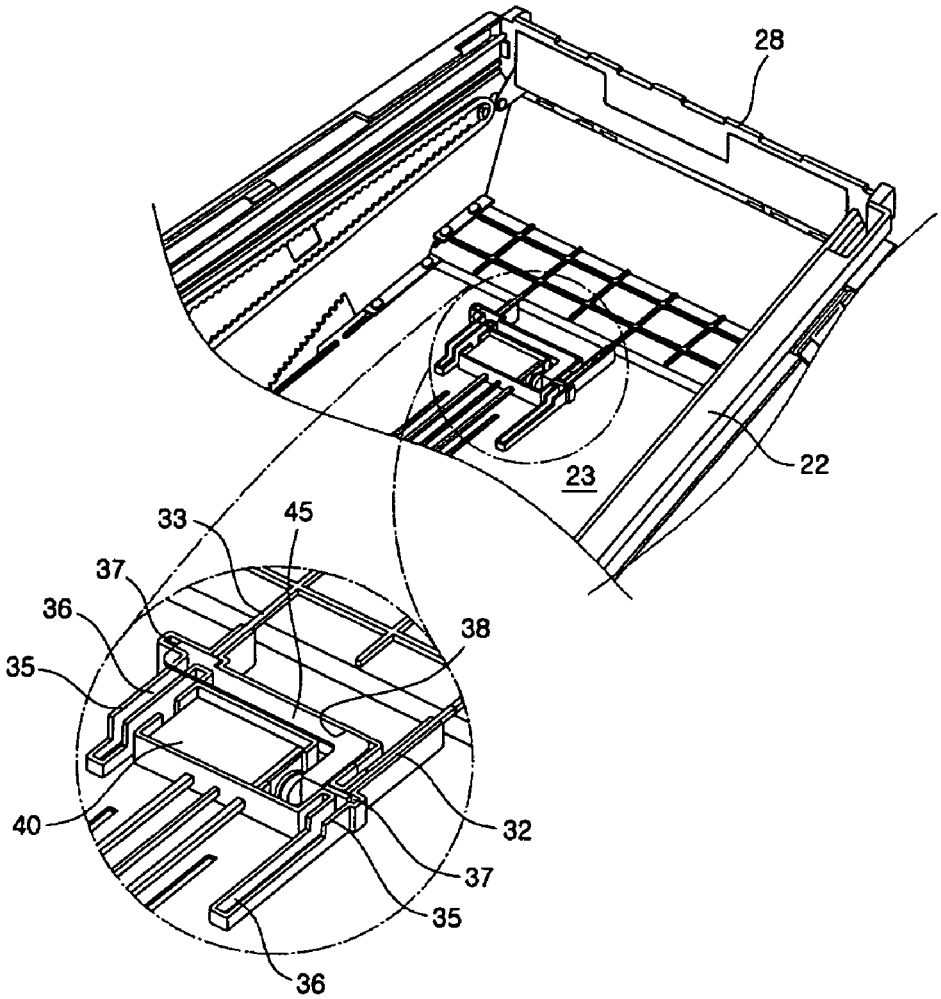
FIG. 3 is a perspective view showing the internal configuration of the media cassette, according to the present invention.

Hereinafter, preferred embodiments of an open/close device of a media cassette for a media dispenser according to the present invention will be described in detail with reference to the accompanying drawings.

As shown in the figures, an external appearance of a media cassette 20 is defined by a cassette body 22 in which a storage space 23 is formed. Media are supported and filled in a row within the storage space 23. To this end, a structure for supporting and moving the media is provided in the storage space 23. The storage space 23 is open toward the cassette body 22, and the open storage space 23 is opened and closed by a cassette cover 24. That is, an operation of filling the media in the storage space is performed in a state where the cassette cover 24 is opened.

A media discharging opening 26 is formed at a side of the cassette body 22. The media discharging opening 26 is a portion through which media are discharged when the media cassette 20 is mounted to the media dispenser. The media discharging opening 26 is formed at a front end of the cassette body 22. The media discharging opening 26 is formed to have a width slightly greater than that of the media.

The media discharging opening 26 is selectively opened and closed by means of a discharging door 28. In this embodiment, the discharging door 28 is formed to take the shape of a generally rectangular plate. Both ends of the discharging door 28 are guided, along a guide structure formed on the cassette body 22, to be lifted or lowered in a vertical direction.

Figure 4:
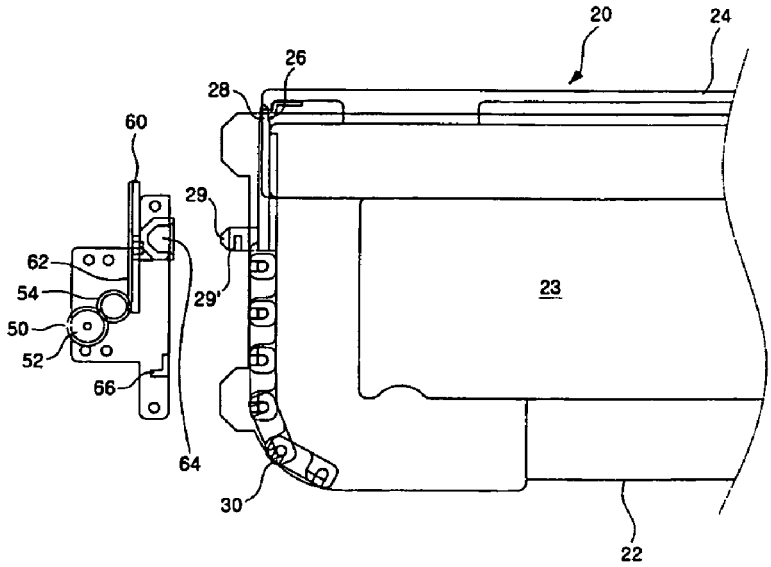
FIG. 4 is a partial schematic side view showing the discharging door and opening unit of the present invention.

A hook protrusion 29 is formed at a side on a front surface of the discharging door 28. The hook protrusion 29 is inserted into a protrusion insert portion 64 to be explained later and receives power used to open and close the discharging door 28. As shown in FIG. 4, the hook protrusion 29 is formed with a locking hole 29' on a lower side thereof.

A connection chain 30 is provided at a lower end of the discharging door 28 to have a predetermined length. The connection chain 30 is composed of a plurality of rectangular plates that are pivotally hinged through pins to one another. The connection chain 30 is a structure for connecting the discharging door 28 and supporting rods 32 and 33, to be explained later, in such a manner that they move perpendicularly to each other. Therefore, if the discharging door 28 and the supporting rods 32 and 33 can be connected to each other such that they can move perpendicularly to each other, it is not necessary to use the connection chain 30.

Figure 5:
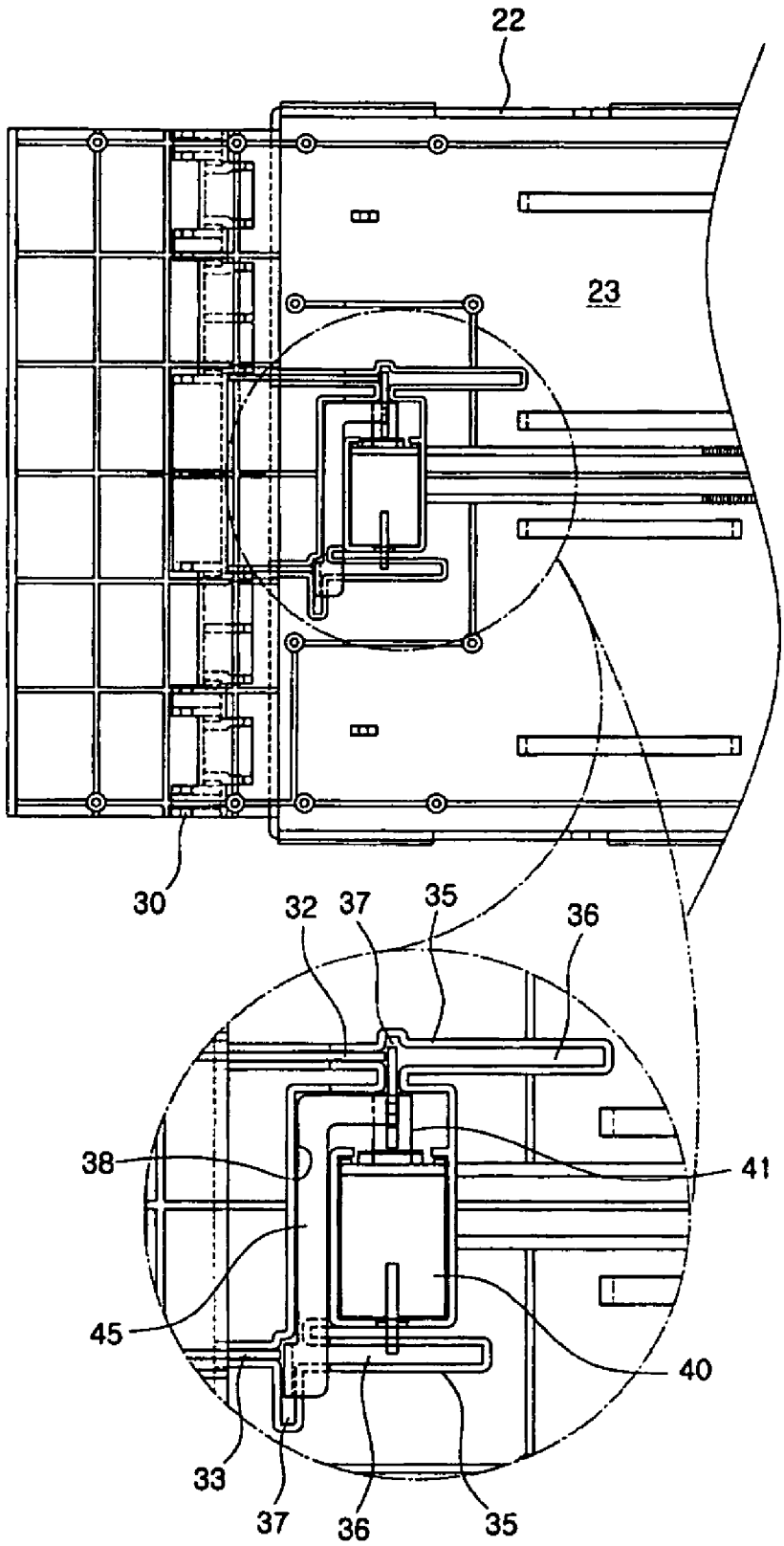
FIG. 5 is a plan view of the locking mechanism of the present invention.

As shown in FIG. 5, the long and short supporting rods 32 and 33 are connected to the connection chain 30 at a side opposite to the discharging door 28. The long and short supporting rods 32 and 33 are installed on a floor surface of the cassette body 22 to move linearly thereon. The long and short supporting rods 32 and 33 are formed to have different lengths from each other.

To this end, guide ribs 35 are formed on the floor surface of the cassette body 22. The guide ribs 35 may be integral with the floor surface, or separately formed and then attached to the floor surface of the cassette body 22. Rod guide channels 36 within which the long and short supporting rods 32 and 33 can be moved are formed by the guide ribs 35. The rod guide channels 36 are formed to correspond to the length of each relevant rod 32 or 33.

Stopper guide channels 37 along which first and second stopper portions 46 and 47 of a locking plate 45 (see FIG. 6) move are also formed by the guide ribs 35. The stopper guide channels 37 are formed perpendicular to the rod guide channels 36. In addition, a plate seating portion 38 for guiding the movement of the locking plate 45 is formed by the guide ribs 35.

A solenoid 40 is installed on the floor surface of the cassette body 22 on which the guide ribs 35 are provided. The solenoid 40 is provided with a plunger 41 that can be moved toward and away from the solenoid 40. The solenoid 40 is powered and operated when the media cassette 20 is mounted to the media dispenser. The plunger 41 of the solenoid 40 is supported on an elastic member (not shown) and protrudes outward from the solenoid when the solenoid is not powered.

Figure 6:
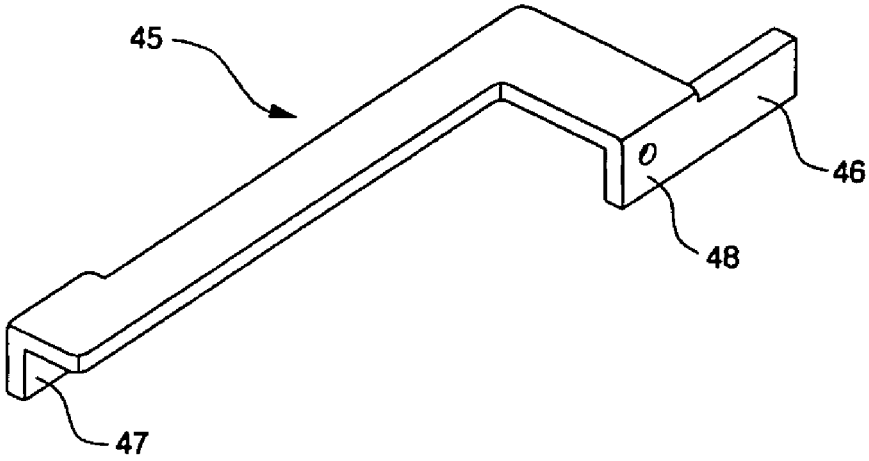
FIG. 6 is a perspective view of a locking plate according to the present invention.

The configuration of the locking plate 45 is shown in FIG. 6. The locking plate 45 securely rests on the plate seating portion 38, and can move vertically within the plate seating portion 38, as viewed on FIG. 5. The first and second stopper portions 46 and 47, that are seated into the stopper guide channels 37, are formed at both ends of the locking plate 45. The first and second stopper portions 46 and 47 are bent perpendicular at both ends of the locking plate 45. Further, a connection portion 48 is formed adjacent to the first stopper portion 46. The connection portion 48 is connected to the plunger 41 of the solenoid 40.

The first stopper portion 46 is securely seated into the stopper guide channel 37 corresponding to the long supporting rod 32 to selectively block an end of the long supporting rod 32. Further, the second stopper portion 47 is securely seated into the stopper guide channel 37 corresponding to the short supporting rod 33 to selectively block an end of the short supporting rod 33.

As shown in FIG. 4, a driving motor 50, for driving the discharging door 28 in the open and closed directions, is provided at a main body side of the media dispenser. A driving gear 52 is provided at a rotary shaft of the driving motor 50, and a connection gear 54 is also provided to be engaged with the driving gear 52. An opening rack unit 60 is provided to be engaged with the connection gear 54. The opening rack unit 60 is formed with a rack gear 62 engaged with the connection gear 54. The rack gear 62 is formed at an interval corresponding to an opening/closing stroke of the discharging door 28. The opening rack unit 60 is moved in a vertical direction as viewed in FIG. 4. The movement of the opening rack unit 60 is guided by an additional structure (not shown).

The opening rack unit 60 is formed with the insert portion 64 into which the hooking protrusion 29 formed on the discharging door 28 is inserted. The hooking protrusion 29 is inserted into the insert portion 64 so as to transmit a driving force from the driving motor 50 to the discharging door 28.

Further, a fastening hook 66 in which the hooking protrusion 29 of the discharging door 28 is caught is provided at the main body side of the media dispenser. The fastening hook 66 is provided at a position where it can be automatically inserted into the locking hole 29' of the hooking protrusion 29 when the discharging door 28 is opened.

Figure 8:
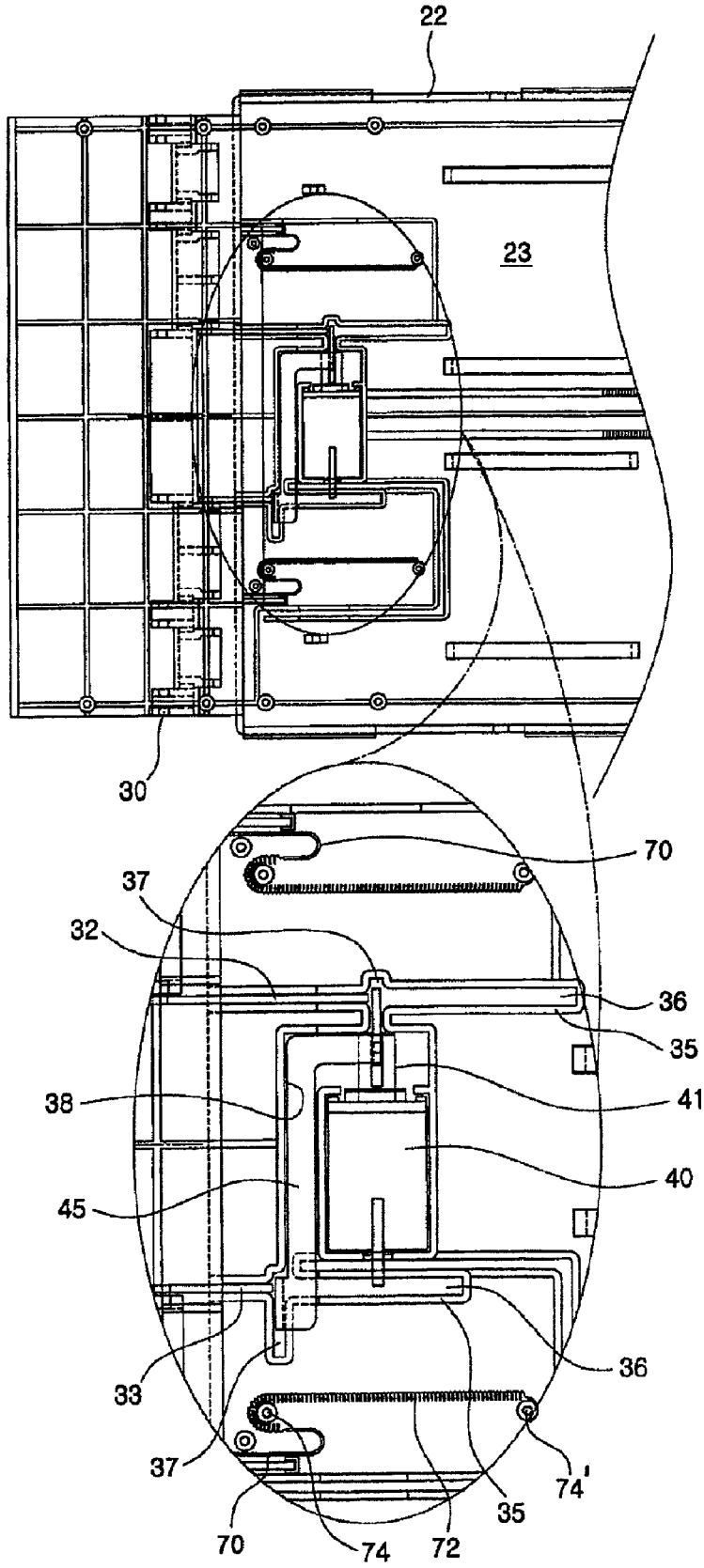
FIG. 8 is a plan view of the locking mechanism, according to an alternate embodiment of the present invention.

FIG. 8 is a plan view showing the configuration of another embodiment of the present invention. In this embodiment, the same elements as those in the previous embodiment are designated with the same reference numerals for the sake of convenience.

Referring to FIG. 8, a structure is provided to automatically bias the discharging door 28 to close the discharging opening 26. Closing rods 70 are provided such that an end thereof is connected to the discharging door 28. The closing rods 70 are provided at both sides of the solenoid 40. Of course, only a single closing rod 70 may be installed at one side of the solenoid 40, but if desired two closing rods are preferably provided at both ends of the solenoid 40, as illustrated, so as to ensure operating reliability.

Each of the closing rods 70 has a tendency to move, by means of a closing spring 72, in a direction in which the discharging door 28 moves to close the media discharging opening 26. An end of the closing spring 72 is connected to a distal end of the closing rod 70, and the other end of the closing spring 72 is connected to one side of the cassette body 22. A coil spring may be used as the closing spring 72.

In this embodiment, first and second bosses 74 and 74' are installed on the cassette body 22 at a predetermined interval. The first boss 74 is formed at a position relatively adjacent to the discharging door 28, while the second boss 74' is formed at a position far away from the first boss 74. The bosses 74 and 74' are spaced from each other in a direction in which the closing rods 70 move to close the discharging door 28.

An end of the closing spring 72 is connected to the closing rod 70. The closing spring extends slightly toward the discharging door 28 and then is wound around the first boss 74 to turn around 180 degrees. Finally, the other end of the closing spring 72 is connected to the second boss 74'. Therefore, the closing spring 72 operates in such a manner that the closing rod 70 can push the discharging door 28 closed.

Hereinafter, the operation of the open/close device of the media cassette 20 for the media dispenser according to the present invention will be described in detail. First, as seen from FIGS. 4 and 5, the media discharging opening 26 is closed by the discharging door 28 when the media cassette 20 is not mounted into the media dispenser. In the closed state, the discharging door 28 is positioned where its leading end is moved to an uppermost position, and thus, each of the supporting rods 32 and 33 connected to the discharging door by means of the connection chain 30 is in a state where it is fully pulled toward a front end of the cassette body 22.

Further, the distal ends of the supporting rods 32 and 33 are blocked by the stopper first and second portions 46 and 47 of the locking plate 45. That is, the first and second stopper portions 46 and 47 are positioned across the rod guide channels 36 so that the supporting rods 32 and 33 cannot move along the rod guide channels 36 away from the discharging door 28 end of the media cassette 20.

When the media cassette 20 is completely mounted into the media dispenser, the hooking protrusion 29 of the discharging door 28 is inserted into the insert portion 64. Then, electrical power is supplied to the solenoid 40 in the media dispenser, so that the plunger 41 of the solenoid 40 is driven. After the power is supplied to the solenoid 40, it is immediately shut off.

Figure 7A:
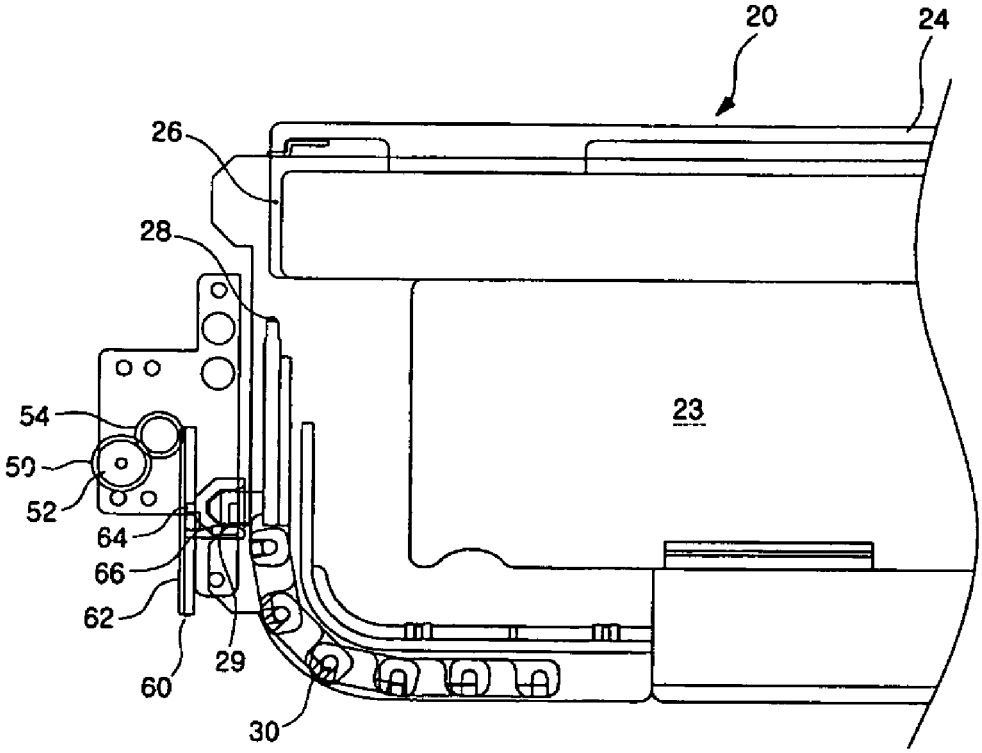
FIGS. 7*a* and 7*b* are views showing a state where a discharging door is opened.
Figure 7B:
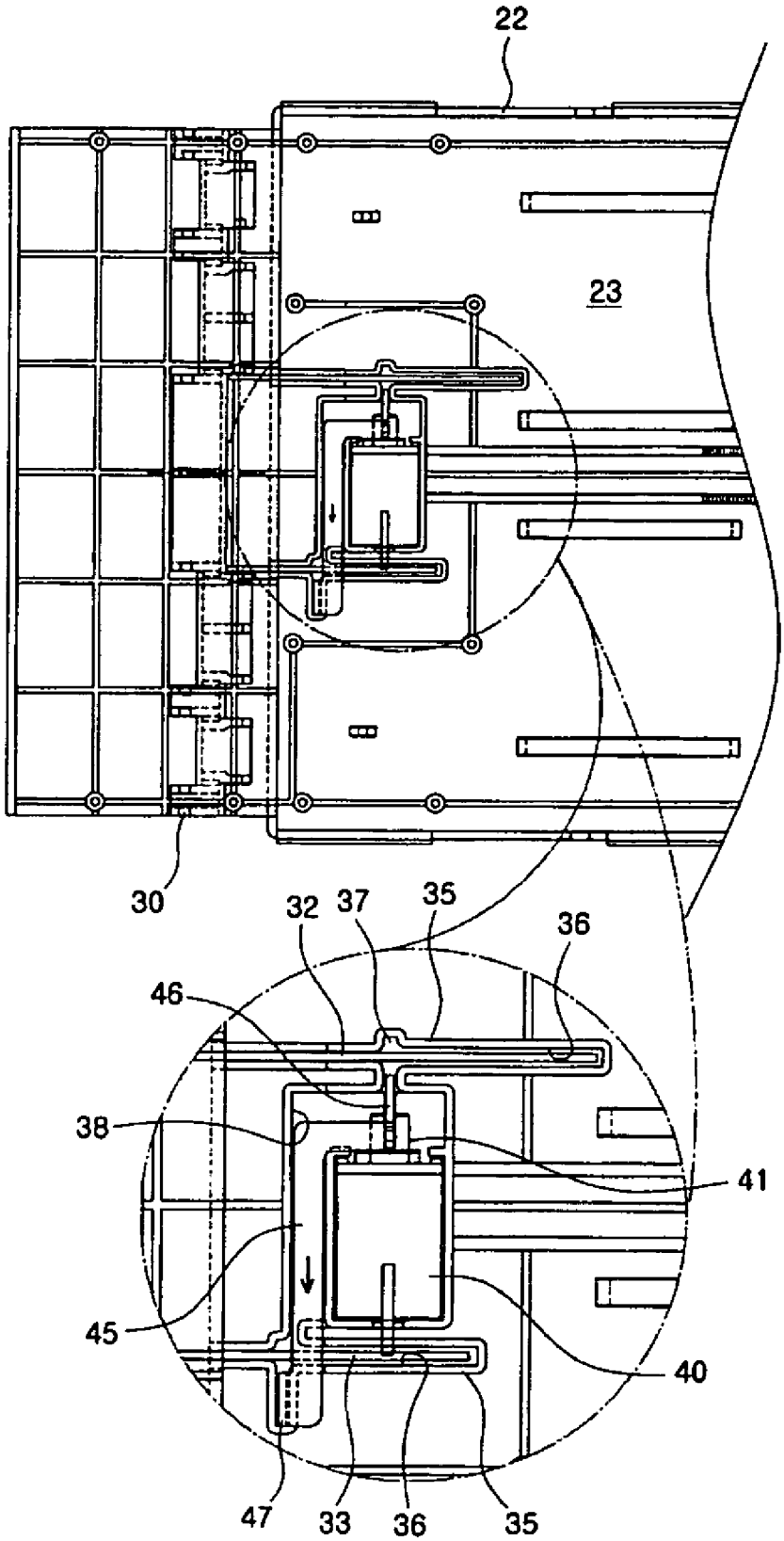

When the plunger 41 retracts into the solenoid 40, the locking plate 45 is moved in a direction designated by an arrow shown in FIG. 7*b*. Therefore, the first and second stopper portions 46 and 47 of the locking plate 45 do not come across the rod guide channels 36 but are positioned in the stopper guide channels 37. Accordingly, the first and second stopper portions 46 and 47 no longer block the ends of the supporting rods 32 and 33, and thus, the supporting rods 32 and 33 are in state where they can freely move along the rod guide channels 36.

When the driving motor 50 is driven, in such a state, the driving gear 52 is rotated. The driving force from the driving motor 50 is transferred to the opening rack unit 60 sequentially through the driving gear 52, the connection gear 54 and the rack gear 62. Therefore, the opening rack unit 60 is moved downwardly, as shown in FIG. 7*a*, together with the discharging door 28 with the hooking protrusion 29 inserted into the insert portion 64.

When the discharging door 28 is moved downwardly by means of the driving force from the driving motor 50, the media discharging opening 26 is opened to be in a state where the media in the storage space 23 can be discharged to the outside through the media discharging opening 26.

If the discharging door 28 is completely opened, the fastening hook 66 is locked into the locking hole 29' of the hooking protrusion 29. Accordingly, the fastening hook 66 causes the media cassette 20 to be fastened into the media dispenser.

When the media cassette 20 is to be detached from the media dispenser, the discharging door 28 is first closed using the driving force from the driving motor 50. As the discharging door 28 is being closed, the fastening hook 66 is automatically unlocked from the locking hole 29' of the hooking protrusion 29.

When the discharging door 28 is closed, the supporting rods 32 and 33 connected to the discharging door 28 by means of the connection chain 30 are moved along the rod guide channels 36 and the ends thereof are then placed at positions past the stopper guide channels 37. After the supporting rods 32 and 33 pass by the stopper guide channels 37, the plunger 41 of the solenoid 40, to which power is already shut off, protrudes automatically due to an elastic force of the elastic member. Therefore, the locking plate 45 is moved causing the first and second stopper portions 46 and 47 to block the ends of the supporting rods 32 and 33, whereby the discharging door 28 cannot be arbitrarily or inadvertently opened.

Meanwhile, in the embodiment shown in FIG. 8, the discharging door 28 always tends to move in a closing direction by means of the elastic force of the closing springs 72. Therefore, when the discharging door 28 is closed due to the driving force from the driving motor 50, it can be more firmly closed due to the elastic force of the closing springs 72. Accordingly, it is even more assured that when the media cassette 20 is detached from the media dispenser, the discharging door 28 will be completely closed.

Although two supporting rods and closing rods are illustrated in the present invention, there may be more rods. In such a case, more stopper portions on the locking plate should be provided in accordance with the number of the supporting rods.

According to the present invention as described in detail above, the following advantages can be obtained. Since the structure for locking the discharging door, used to close the media discharging opening of the media cassette, is provided inside the cassette body, it cannot be handled or tampered with from outside. Therefore, there is a reduced possibility of having media stolen, while the media cassette is carried in a state where it is detached from the media dispenser.

In particular, the discharging door is closed while the media cassette is still in the media dispenser, and the discharging door is prevented from being opened due to the locking plate. Therefore, the user cannot inadvertently carry the media cassette in a state where the discharging door is not closed. By this arrangement, the possibility of having media stolen is greatly reduced.

Further, when the media cassette is mounted into the media dispenser, the discharging door is opened and the hooking protrusion is simultaneously fastened to the fastening hook. Thus, the media cassette is automatically fastened to the media dispenser. Therefore, the arrangement prevents the media cassette from being detached from the media dispenser in a state where the discharging door is opened.

Furthermore, there is an advantage in that the operation of closing the media discharging opening by means of the discharging door can be clearly performed while the media cassette is detached from the media dispenser.

The scope of the present invention is not limited by the illustrated embodiments but defined by the appended claims. It will be apparent that those skilled in the art can make various modifications and changes within the scope of the invention defined by the claims.

What is claimed is:

1. A media cassette for a media dispenser, comprising:

a cassette body including a space in which media are filled and a media discharge opening through which the media are discharged;

a door being driven by a driving source for opening and closing said media discharge opening;

a supporting rod connected to said door to move therewith, said supporting rod being disposed on an interior floor space of the cassette body such that motion of the door causes said supporting rod to move along the interior floor space; and a locking mechanism for selectively engaging a portion of said supporting rod in said cassette body and selectively locking/unlocking said door in accordance with an electrical signal transmitted from the main body of the media dispenser, wherein said locking mechanism is disposed on the interior floor space of the cassette body such that the locking mechanism can not be accessed when the door is closed and the media cassette is removed from the media dispenser, the media being placed on the interior floor space, and wherein the locking mechanism engages the portion of said supporting rod to lock the door when motion of said supporting rod caused by the motion of the door aligns the locking mechanism and the portion of said supporting rod.

2. The media cassette of claim 1, wherein said door is movable along one surface of the cassette body to open and close said media discharge opening.

3. The media cassette of claim 1, wherein said discharge opening is provided in a side of said cassette body.

4. The media cassette of claim 1, wherein said locking mechanism selectively engages an end of said support rod.

5. The media cassette of claim 1, wherein said supporting rod moves in a direction which is substantially perpendicular to a direction of movement of said door.

6. The media cassette of claim 5, wherein said supporting rod is connected to said door by a connection chain.

7. The media cassette of claim 5, wherein said supporting rod is a first supporting rod having a first length, and further comprising:

a second supporting rod having a second length different than said first length, wherein said second supporting rod is connected to said door to move therewith.

8. The media cassette of claim 7, wherein said second supporting rod and said first supporting rod move in directions, which are substantially parallel to one another.

9. The media cassette of claim 8, wherein said locking mechanism includes:

a solenoid installed within said cassette body and including a plunger which can be moved toward and away from said solenoid; and a locking plate connected to said plunger to be driven by said solenoid, said locking plate including first and second stopper portions for selectively blocking movement of said first and second supporting rods, respectively.

10. The media cassette of claim 1, wherein said locking mechanism includes:

a solenoid installed within said cassette body and including a plunger which can be moved toward and away from said solenoid; and a locking plate connected to said plunger to be driven by said solenoid, said locking plate including a stopper portion for selectively blocking movement of said supporting rod.

11. The media cassette of claim 10, wherein said plunger is withdrawn toward said solenoid when said solenoid is powered, and wherein said plunger protrudes away from said solenoid under the biasing force an elastic member when said solenoid is un-powered.

12. The media cassette of claim 10, further comprising:

a rod guide channel formed in said cassette body along which said supporting rod moves; and a stopper guide channel formed in said cassette body along which said stopper portion of said locking plate moves.

13. The media cassette of claim 12, wherein said rod guide channel is substantially perpendicular to said stopper guide channel.

14. The media cassette of claim 1, further comprising:

a door closing assistance mechanism attached to said cassette body for assisting in closing of said discharging door.

15. The media cassette of claim 14, wherein said door closing assistance mechanism includes:

a closing rod disposed within said cassette body and being connected to an end of said door; and an elastic member having a first end connected to an end of said closing rod, and having a second end connected to said cassette body, wherein said elastic member imparts a force to said closing rod in a direction which tends to cause said closing rod to close said door.

16. A media dispenser for dispensing media comprising:

a media cassette including:

a cassette body including a space in which media are filled and a media discharge opening through which the media are discharged;

a door being driven by an opening unit for opening and closing said media discharge opening, wherein said door includes:

a guide located on a wall of said cassette body;

a chain-linked portion sliding along said guide, wherein said chain-linked portion bends around an edge of said cassette body to open said media discharge opening;

a supporting rod connected to said door to move therewith, said supporting rod being disposed on an interior floor space of the cassette body such that motion of the door causes said supporting rod to move along the interior floor space; and a locking mechanism for selectively engaging a portion of said supporting rod in said cassette body and selectively locking/unlocking said door in accordance with an electrical signal transmitted from said media dispenser; and belts or rollers for moving sheets of media from said media cassette to an opening for dispensing to a customer, wherein said opening unit opens said door when said media cassette is coupled to said dispenser, wherein said opening unit includes a moveable unit having a receiver for engaging a portion of said door to move said door to an open position, wherein said locking mechanism is disposed on the interior floor surface of the cassette body such that the locking mechanism cannot be accessed when the door is closed and the media cassette is removed from the media dispenser, the media being placed on the interior floor space, and wherein the locking mechanism engages the portion of said supporting rod to lock the door when motion of said supporting rod aligns the locking mechanism and the portion of said supporting rod.

17. The media cassette of claim 1, further comprising:

a rod guide channel formed in said cassette body along which said supporting rod moves, wherein when the driving source closes the door, the supporting rod moves with the closing of the door from a first position to a second position along the rod guide channel, and the locking mechanism moves to a third position along the rod guide channel that is between the first and second positions to block the supporting rod from moving back to the first position.

18. The media cassette of claim 17, wherein when the driving source opens the door, the locking mechanism retracts from the third position such that the supporting rod moves with the opening of the door to the first position along the rod guide channel.

* * * * *